US012171333B2

(12) United States Patent
Heffel

(10) Patent No.: US 12,171,333 B2
(45) Date of Patent: Dec. 24, 2024

(54) TELESCOPIC EXTENSION

(71) Applicant: Accuride International GmbH, Diez (DE)

(72) Inventor: Andreas Heffel, Dierdorf (DE)

(73) Assignee: Accuride International GmbH, Diez (DE)

( * ) Notice: Subject to any disclaimer, the term of this patent is extended or adjusted under 35 U.S.C. 154(b) by 0 days.

(21) Appl. No.: 18/209,740

(22) Filed: Jun. 14, 2023

(65) Prior Publication Data

US 2024/0099460 A1 Mar. 28, 2024

(30) Foreign Application Priority Data

Jun. 15, 2022 (DE) ..... 10 2022 115 063.1

(51) Int. Cl.
*A47B 77/04* (2006.01)
*A47B 45/00* (2006.01)
*F24C 15/16* (2006.01)

(52) U.S. Cl.
CPC ..... *A47B 77/04* (2013.01); *A47B 45/00* (2013.01); *F24C 15/168* (2013.01)

(58) Field of Classification Search
CPC ..... A47B 77/04; A47B 45/00; A47B 88/43; A47B 88/57; F24C 15/168; F24C 15/16; F25D 25/024; F25D 23/067; H05K 7/1401; H05K 7/1489; H05K 7/1491
See application file for complete search history.

(56) References Cited

U.S. PATENT DOCUMENTS 8,162,560 B2 * 4/2012 Wittgrebe ..... A47B 88/43 248/220.21
8,573,720 B2 * 11/2013 Wittgrebe ..... A47L 15/504 126/339

(Continued)

FOREIGN PATENT DOCUMENTS

DE 202005020458 U1 5/2007
DE 102009046573 A1 5/2011

(Continued)

OTHER PUBLICATIONS

European Search Report for EP Patent Application No. 23177468.8, Issued on Oct. 10, 2023, 9 pages of original document only.

*Primary Examiner* — Ko H Chan
(74) *Attorney, Agent, or Firm* — Faegre Drinker Biddle & Reath LLP

(57) ABSTRACT

A telescopic extension with a stationary inner rail and an outer rail mounted so as to be movable relative to the stationary inner rail between an insertion end position and an extension end position in an insertion direction and an extension direction opposite thereto. The telescopic rail is provided and designed for detachable mounting on a side rack which includes a front vertical grid bar and a rear vertical grid bar spaced apart therefrom and substantially parallel thereto, and at least one support bracket which has a horizontal section and, at opposite ends of the horizontal section, front and rear end sections which are each angled substantially perpendicularly with respect to the horizontal section, the front end section being connected to the front vertical grid bar and the rear end section being connected to the rear vertical grid bar.

21 Claims, 8 Drawing Sheets

(56) References Cited

U.S. PATENT DOCUMENTS

| | | | | |
|---|---|---|---|---|
| 8,820,689 | B2 * | 9/2014 | Reidt | F24C 15/168 248/220.21 |
| 8,851,591 | B2 * | 10/2014 | Meier | A47B 88/43 126/339 |
| 9,078,517 | B2 * | 7/2015 | Rehage | A47B 88/43 |
| 9,447,914 | B2 * | 9/2016 | Neace | F16B 45/00 |
| 11,712,114 | B2 * | 8/2023 | Lee | F24C 15/168 211/162 |
| 2005/0217501 | A1 * | 10/2005 | Babucke | F24C 15/168 99/450 |
| 2009/0016812 | A1 * | 1/2009 | Wittgrebe | F16B 7/0433 403/189 |
| 2009/0127217 | A1 * | 5/2009 | Wittgrebe | A47L 15/507 211/162 |
| 2011/0123260 | A1 * | 5/2011 | Budde | F16B 7/0433 403/188 |
| 2012/0090594 | A1 * | 4/2012 | Rehage | F24C 15/168 126/339 |
| 2018/0084910 | A1 * | 3/2018 | Homburg | F24C 15/16 |
| 2021/0293416 | A1 * | 9/2021 | Homburg | F24C 15/168 |

FOREIGN PATENT DOCUMENTS

| | | | |
|---|---|---|---|
| DE | 202018000552 | U1 | 3/2018 |
| EP | 2325565 | A2 | 5/2011 |
| EP | 2325565 | A3 | 11/2017 |
| WO | 2019/149511 | A1 | 8/2019 |

* cited by examiner

TELESCOPIC EXTENSION

CROSS REFERENCE TO RELATED APPLICATIONS

This application Ser. No. 18/209,740, filed Jun. 14, 2023, claims benefit of German Patent Application No. 10 2022 115 063.1 filed Jun. 15, 2022, which is herein incorporated by reference in its entirety.

SUBJECT MATTER OF THE INVENTION

The present invention relates to a telescopic extension provided and adapted for detachable mounting on a side rack, preferably a side rack that is fixed or fixable to the inner side wall of an oven. The telescopic extension comprises a stationary inner rail, an outer rail mounted so as to be movable relative to the stationary inner rail between an insertion end position and an extension end position in an insertion direction and an opposite extension direction, optionally a middle rail arranged between the inner rail and the outer rail and mounted so as to be movable relative thereto, and optionally, but preferably, a support plate which is attached to the outer rail and is suitable for supporting a holder, preferably a cooking tray or a roasting grid in a baking oven. The invention also relates to a quick-fastening system for mounting cooking tray supports in an oven having a pair of mirror-symmetrically formed side racks which are fixed or fixable to opposite inner side walls of the oven, and having at least one pair of telescopic extensions of the type according to the invention.

BACKGROUND OF THE INVENTION

Telescopic extensions for baking ovens, but also for other applications such as furniture, technical cabinets, computer racks, etc., have a stationary rail element which is fixed to the body, and at least one rail element which is mounted so that it can move relative to the stationary rail element by sliding on sliding surfaces or rolling on balls or other rolling bodies, for pulling out and pushing in an extension, such as a drawer, a tray or a cooking tray, which is attached to or placed on it. Particularly in the case of ovens, but also in other applications, it may be necessary or at least advantageous if the telescopic extensions can be easily assembled and disassembled without tools in order to replace them, clean them or simply position them at a height in the body that is required at the time; e.g. in the muffle of a baking oven.

In many commercially available baking ovens wherein the present invention is particularly preferred and can be used advantageously, two opposing side racks are attached to the inner walls of the baking oven muffle, which are used for inserting or placing cooking trays (baking trays, baking grids, drip trays, etc.) or also for attaching telescopic extensions.

Typically, such side racks in the intended version mounted on a body wall, such as the inner muffle wall of a baking oven, have at least two vertical grid bars arranged substantially parallel to each other and usually a plurality of substantially horizontally aligned retaining brackets which are attached to the vertical grid bars and connect them. The horizontal retaining brackets of the side racks arranged on both sides on the inner walls of the muffle of a baking oven are used for placing or inserting the cooking trays, which is why they usually extend from the plane spanned by the vertical grid bars towards the inside of the muffle. The retaining brackets have a horizontal section extending horizontally and substantially straight across the distance between the vertical grid bars. For connection with and attachment to the vertical grid bars, the horizontal grid bars have substantially vertically angled end sections at their opposite ends, the free ends of which are fixed, usually welded, to the vertical grid bars.

To prevent the cooking tray from tipping when it is not completely pulled out of the muffle of the oven—for example, for processing or inspecting the food—pairs of horizontal retaining brackets are normally provided on such side racks, which are arranged at a small distance above one another, which is sufficiently large to insert the cooking tray with its side edges between the two horizontal bars, but simultaneously sufficiently small to enable the cooking tray to be secured against tipping with a rear section of its side edge on the upper retaining bracket when it is not completely pulled out of the muffle of the baking oven. The bars of such side racks are generally made of a wire with a circular cross-section, as this allows for cost-effective production.

Modern and higher-quality ovens are equipped with telescopic extensions for holding and moving the cooking trays. In addition to the smooth movability of the cooking trays, another advantage of using telescopic extensions is that, with a sufficient number of movable rail elements, e.g. full extensions with three or more rail elements, they also allow the cooking tray to be pulled completely out of the muffle without allowing the cooking tray to tip. It is practical to attach the telescopic extensions to the existing side racks, aiming for a stable but easily mounted and detached attachment, which should simultaneously be secure against unintentional loosening of the attachment, e. g. when the cooking tray is removed or pushed in.

For the detachable fastening of telescopic extensions to side racks, different quick fastening systems are already known, wherein at least one, often two or even more fastening elements are provided for connecting the telescopic extension to the bars of the side rack. One requirement for their suitability and acceptance is ease of handling when mounting and removing the telescopic extension, while simultaneously securing the telescopic extension against tilting and shifting when mounted, as well as against unintentional loosening or lifting of the attachment. Another aspect lies in the economic manufacturability of the fastening system, taking into account the manufacturing process and the amount of material required for the fastening elements as well as their fastening to the telescopic extension.

Known systems for detachable attachment of telescopic extensions to side racks usually use two fastening elements affixed to the stationary inner rail of the telescopic extension, which engage either with only one retaining bracket of the side rack, or with two retaining brackets arranged a short distance above each other. Engagement with the horizontal sections of two retaining brackets arranged one above the other usually ensures tip prevention for the telescopic extension, whereas engagement with the horizontal section of only one retaining bracket requires further engagement with one or both vertical grid bars and/or one or both angled end sections of the retaining bracket for tip prevention. Systems are also known in which the telescopic extension is fixed only by engagement with one or both vertical grid bars and one or both angled end sections of the retaining bracket.

EP 2 403 380 describes a quick-fastening device for telescopic extensions on a side rack of, for example, a baking oven with two fastening elements called clamps, which are fastened to the underside of the stationary rail element in the vicinity of the two end sections, and with which the telescopic extension is mounted on the upper side, and not on the side of a side rack retaining bracket that faces the muffle interior, so that the telescopic extension is placed as closely as possible to the muffle side wall and projects only slightly into the muffle interior. The two clamps each have U-shaped sections that are pushed onto the retaining bracket horizontally and in a direction perpendicularly to the muffle side wall, and grip around it like a clamp for mounting the telescopic extension. Furthermore, sections are provided on the clamps to support themselves on or grasp around the vertical bars of the side rack. The clamps are intended to support the telescopic extension against shifting and tilting on the grid bars of the side rack in several spatial directions. In a variant of the clamps provided for mounting the telescopic extension in the front section facing the muffle opening, a spring-mounted catch is provided, with which the clamp is latched to the bent end section or the horizontal section of the retaining bracket. In this case, the catch engages behind the retaining bracket on a side that is difficult for a user to access, which would make it difficult to disengage the catch for disassembly if the catch were not provided with a slope in the area adjacent to the retaining bracket, which is obviously intended to ensure easier removal of the clamp from the retaining bracket. However, this also makes it easier for the telescopic extension to accidentally detach from the side rack.

EP 1 965 680 describes a quick-release fastening system for fastening a telescopic extension to a side rack, for example of a baking oven, with two quick-release fasteners which are fastened in the vicinity of the two end sections on the side of the stationary rail element facing the muffle side wall, and with which the telescopic extension is mounted on the side of a retaining bracket of the side rack facing the muffle interior. Each of the two quick-release fasteners has two U-shaped sections that are oriented substantially at a 90° angle to each other. A first U-shaped section of each of the two quick-release fasteners clasps around the horizontal section of the retaining bracket, with the opening of the U-shaped section facing towards the muffle side wall. The second U-shaped section of each of the two quick-release fasteners, which is arranged perpendicularly to the first U-shaped section, engages around the retaining bracket at one of the angled end sections in each case, with the openings of these second U-shaped sections of the two quick-release fasteners facing each other. As with the previously described quick-release fastening device, the telescopic extension with the two quick-release fasteners for mounting the telescopic extension is pushed onto the retaining bracket horizontally and in a direction perpendicular to the muffle side wall. The second U-shaped sections embracing the grid bar at the angled end sections prevent the telescopic extension from tilting. An embossed catch is provided on the first U-shaped sections for engagement with the horizontal section of the retaining bracket to secure the fastening element to the grid bar, so that force must be applied when inserting the quick-release fasteners in order to lock the U-shaped sections to the grid bar. For mounting the rear quick-release fastener close to the back wall of the muffle, this requires an operator to reach far into the baking oven muffle to position the rear end of the telescopic extension with the rear quick-release fastener precisely at the angled end section of the retaining bracket and apply the force required to engage it.

In the telescopic extensions for baking ovens described above and in many other known extensions, the movable outer rail serves as a support for the cooking tray and has an end stop at the rear end of the outer rail extending vertically upwards from the support surface, which is intended to prevent the cooking tray from being pushed over the end of the rail to the rear wall of the muffle when it is inserted into the baking oven and the outer rail has reached its insertion end position. In addition, a stop or safety device is also provided at the front end of the rail element facing the muffle opening to prevent the cooking tray from being pulled down from the telescopic extension when it is pulled out of the oven and the outer rail has reached its extension end position. These stops are usually manufactured as separate elements and welded or riveted to the outer rail element.

Modern higher-quality ovens have a pyrolysis function for cleaning the oven. In the pyrolysis process, the oven is heated to a temperature of up to 500° C. for a period of about one to three hours to burn or pyrolyse soiling such as food residues or fat splashes from baking and roasting. The granular pyrolysate can then be easily wiped out or vacuumed away.

Over time, repeated pyrolysis causes the rail elements, which are usually made of steel or stainless steel, to tarnish, darken and become stained, which is undesirable for aesthetic reasons, especially with the outer rail visible to the user when the telescopic extension is assembled, and can give the visual impression that dirt is still present.

Various coatings for steel and stainless steel are known which can prevent or at least reduce discolouration of the surfaces even with repeated pyrolysis, and in some cases also reduce the adhesion of dirt. Such coatings can be applied to the components of a telescopic extension with acceptable economic effort, for example in vapour deposition processes or plasma coating processes, wherein the entire surface of the component is usually coated. However, applying such coatings to the outer rail of the telescopic extension or to a ready-assembled telescopic extension has the disadvantage that, without elaborate masking of surfaces that are not to be coated, the rolling or sliding element raceways of the rail element or elements are also coated, which in turn can worsen the running and travel characteristics of the telescopic extension and lead to undesirable noises when the rail elements are moved, such as squeaking or rattling.

PURPOSE OF THE INVENTION

The object of the present invention was to provide a telescopic extension for detachable mounting on a side rack, which solves the problems and overcomes the disadvantages described above, allows for simple and safe mounting and removal of the telescopic extension on the side rack, and can be manufactured simply and inexpensively.

DESCRIPTION OF THE INVENTION

This task is solved by a telescopic extension of the type mentioned above with a stationary inner rail and an outer rail mounted so as to be movable relative to the stationary inner rail between an insertion end position and an extension end position in an insertion direction and an extension direction opposite thereto, and optionally with a middle rail arranged between the inner rail and the outer rail and mounted so as to be movable relative thereto, and optionally with a support plate attached to the outer rail, wherein the telescopic extension is provided and adapted for detachable mounting to a side rack having a front vertical grid bar and a rear vertical grid bar spaced therefrom and substantially parallel thereto, and at least one retaining bracket having a horizontal portion and, at opposite ends of the horizontal portion, respective front and rear end portions angled substantially perpendicularly with respect to the horizontal portion, the front end portion being connected to the front vertical grid bar and the rear end portion being connected to the rear vertical grid bar, wherein a front quick-release fastener and a rear quick-release fastener for releasably mounting the telescopic rail to the side rack are fixed to the stationary inner rail at a distance from each other, wherein the front quick-release fastener has a U-shaped section for engagement with the front vertical grid bar and/or with the front angled end portion of the retaining bracket, and the rear quick-release fastener has a U-shaped section for engagement with the rear vertical grid bar and/or with the rear angled end portion of the retaining bracket, the openings of the U-shaped sections of the quick-release fasteners being oriented in opposite directions facing away from the other quick-release fastener, wherein a spring element is arranged in fixed connection with the rear quick-release fastener and/or the stationary inner rail, and this spring element, in the assembled state of the telescopic extension, is supported with a supporting surface in the insertion direction on the side rack, preferably on the rear vertical grid bar and/or the rear angled end section of the retaining bracket and, in the relaxed or pretensioned state, holds the U-shaped section of the front quick-release fastener (4) in engagement with the front vertical grid bar (2*a*) and/or with the front angled end section of the retaining bracket, wherein the stationary inner rail is movable over a distance by applying a force to the stationary inner rail in the insertion direction and against the spring force of the spring element, such that the U-shaped section of the front quick-release fastener can be disengaged from the front vertical grid bar, wherein a safety lug is arranged on an element of the telescopic extension which is mounted so as to be displaceable relative to the stationary inner rail in such a manner that it comes to rest in the insertion direction against the side rack, preferably against the front vertical grid bar or against the end portion which is angled at the front relative to the horizontal portion of the retaining bracket, when the moveably mounted outer rail is displaced into its insertion end position or when a force acts on the moveably mounted outer rail in its insertion end position in the insertion direction and against the spring force of the spring element, and blocks a movement of the stationary inner rail over a distance such that the U-shaped section (4*a*) of the front quick-release fastener can be brought out of engagement with the front vertical grid bar and/or with the front angled end portion of the retaining bracket, wherein the stationary inner rail, the outer rail, which is mounted so as to be movable relative to the stationary inner rail, and the support plate, which is optionally attached to the outer rail, are made of sheet steel, and the safety lug is formed in one piece with the movable mounted outer rail.

DEFINITIONS

Where reference is made herein and in the context of the present invention and its definition to "horizontal", "horizontal orientation", "vertical", "vertical alignment", "top", "bottom", "side", "front" and "back", this is to describe the intended orientation and alignment of the invention, individual elements of the invention or other elements associated with the invention in three-dimensional space and to define the orientation and arrangement of elements relative to each other and the features and embodiments thereof. It is understood that such indications of orientation and arrangement, even if they designate the intended and/or preferred orientation and arrangement of the invention and its elements in three-dimensional space, serve primarily to indicate reference points, reference directions and reference orientations for easier and more comprehensible description and definition of the invention, and do not limit the invention as a whole to a particular orientation in three-dimensional space. However, the horizontal alignment of the telescopic extension on a body or a side rack is the intended alignment.

The term "perpendicular" is not used herein in the sense of "vertical", but to describe an orientation at a right angle (90°) with respect to an orientation, direction or plane mentioned in this context. The terms "top", "above", "from above", "bottom", "below", "from below", "height" and "width" describe positions or directions in relation to the vertical.

When reference is made herein and in the context of the present invention and its definition to "extension direction" and "insertion direction", this describes the two opposite directions of travel of a moveably mounted rail element relative to the stationary rail element or the stationary inner rail of the telescopic extension when the latter is mounted on a side rack by means of the quick-release fasteners according to the invention, in the intended orientation and use of the invention. The term "direction of travel" describes a direction parallel to the "extension direction" and "insertion direction", irrespective of whether the rail element mounted for travel is extended or inserted. When the telescopic extension according to the invention is mounted on a side rack in an oven or other cabinet as intended, the "insertion direction" points in the direction of the rear wall of the oven or cabinet interior.

The telescopic extension according to the invention comprises rail elements which are mounted so that they can move against each other via slide bearings, ball bearings or roller bearings. Preferably, the rail elements are mounted to move against each other via ball bearings. Whenever a ball bearing is referred to in the following, this also includes other bearing forms, as far as this is technically feasible. In a preferred embodiment of the invention, the stationary inner rail and the movable outer rail have a profile which is substantially C-shaped in cross-section, the ball raceways being formed on the two opposing C-legs, and the two C-legs being connected to one another via a preferably straight section, the rail back.

The telescopic extension according to the invention may comprise, in addition to the rail elements which are mounted so as to be movable relative to one another, a support plate which is attached to the outer rail, namely on the side facing away from the inner rail and expediently on the rail back of the outer rail. In a preferred embodiment according to the invention, the telescopic extension has such a support plate. The support plate is used to support a holder, preferably a cooking tray in a baking oven. Conveniently, the support plate therefore has a support surface on the upper side for supporting a holder.

Thus, in the telescopic extension with support plate according to the invention, the holder is not placed directly on the outer rail as in many known systems, but on the support plate, which has various advantages. Whereas the position or vertical height of the support surface for the holder in relation to the side rack in the case of support on the outer rail of a telescopic extension is determined by the positioning of the outer rail, which in turn depends on the positioning of the entire telescopic extension due to the mounting on the further rail element or elements, the support plate provided according to the invention allows the support surface for the holder to be arranged at almost any height above the upper edge of the outer rail by appropriate design and dimensioning of the support plate and its attachment to the outer rail. It is understood that the support surface for the holder on the support plate should be positioned vertically above the upper edge of the outer rail and, expediently, also above the retaining bracket of the side rack on which the telescopic extension is mounted.

Another advantage of the support plate is that it partially or completely hides the view of the outer rail when the telescopic extension is mounted. This allows the design and/or coating of the support plate to determine the visual impression or appearance of the telescopic extension for the user. For the preferred use of the telescopic extension according to the invention in pyrolysis ovens, the support plate can advantageously be provided with a coating which prevents or at least reduces discolouration of the surface even after repeated pyrolysis, without impairing the running and travel properties of the telescopic extension, as can occur when such coatings are applied to the outer rail of the telescopic extension and thus also to the ball raceways.

In one embodiment of the invention, therefore, the surface of the support plate attached to the movable outer rail has a coating extending at least partially, preferably over the entire surface, which is produced by means of PVD, CVD, plasma CVD, plasma spraying or high-speed flame spraying, or an electrodeposited coating, preferably a coating resistant to temperatures up to at least 500° C., particularly preferably a coating based on silicon dioxide or diamond-like carbon (DLC). As a rule, such coatings are transparent, so that the metallic colour of the support plate made of steel or stainless steel is visible. Alternatively, however, coloured coatings can be applied to achieve a desired visual impression.

The support plate can fundamentally be detachably or non-detachably attached to the outer rail. A non-detachable fastening of the support plate to the outer rail can be made by welding, spot welding or riveting. According to the invention, a detachable fastening of the support plate to the outer rail is preferred, especially by means of a bayonet or hook connection. This means that the fastening or assembly of the support plate to the outer rail can advantageously be carried out without tools and without additional parts or complex processes.

In a preferred embodiment of the invention, at least two hook-shaped lugs are arranged on the side of the outer rail facing away from the inner rail for detachable fastening of the support plate to the outer rail, and recesses formed on the side of the support plate facing the outer rail for engagement, preferably bayonet engagement, with the hook-shaped lugs on the outer rail. The hook-shaped lugs conveniently point vertically upwards so that the support plate with the recess fixed to it can be hooked into the hook-shaped lugs from above. With this orientation of the hook-shaped lugs, gravity supports the secure connection of this fastening even during operation. In addition, the lugs and the recess for a latch can be profiled to secure the fastening.

Preferably, the hook-shaped lugs are formed in one piece with the outer rail by punching or cutting out corresponding contours in the steel sheet of the rail back during the manufacture of the outer rail and then bending the material to form the hook-shaped lugs.

In an alternative embodiment, the at least two hook-shaped lugs are provided on the side of the support plate facing the outer rail; the recesses required for engagement with the hook-shaped lugs on the support plate are arranged on the side of the outer rail facing away from the inner rail.

The recesses formed on the outer rail or on the support plate are preferably fixed to the respective component by means of welding, spot welding, riveting or screwing. The recesses can, for example, consist of sheet metal strips that are bent open to engage with the hook-shaped lugs, and which rest against the respective component in horizontal alignment with their end sections opposite each other and are fixed in place.

In another alternative embodiment, the recesses or lugs on the support plate are formed in one piece with the support plate, and are formed in or from a portion folded over along the upper or lower edge of the support plate in the direction of the outer rail, as shown by way of example in FIGS. 7A-C.

It is expedient that the support plate attached to the movable outer rail has an end stop at the end located in the insertion direction, which forms a stop against displacement of a holder placed on the support plate in the insertion direction beyond the end of the support plate located in the insertion direction. The end stop can be welded to the support plate, as is known from end stops on outer rails, which are used directly as a holder support for a telescopic extension. However, this requires an additional process step of welding during manufacture. This can be acceptable in the known use of the outer rail as a holder support, as it allows the use of standard outer rail elements that are also produced in large quantities for other applications. According to the invention, however, the end stop is formed in one piece with the support plate and formed as a lug bent out of the steel sheet of the support plate perpendicular to the insertion direction. Since the support plate is cut or punched from a steel sheet and then bent in any case, the one-piece design of the end stop with the support plate is simpler and more cost-effective in terms of the process.

Furthermore, according to the invention, the support plate that is attached to the movable outer rail preferably has an end cap at the end located in the extension direction. Advantageously, the end cap, like the end stop, is formed in one piece with the support plate as a lug bent out of the steel sheet of the support plate. Preferably, the lug is bent out in the direction of the movable outer rail and at least partially covers the end of the movable outer rail located in the extension direction. The end cap, like the end stop, is also designed and provided as a stop or safety device to prevent the placed holder or cooking tray from being pulled down from the telescopic extension when it is pulled out of the oven, when the outer rail has reached its extension end position.

The telescopic extension according to the invention further comprises, on the stationary inner rail at a distance from each other, a front quick-release fastener and a rear quick-release fastener for detachable mounting of the telescopic extension on the side rack. The quick-release fasteners each have a U-shaped section for engagement with the vertical grid bars and/or with the angled end portions of the side rack retaining bracket, the openings of the U-shaped sections of the quick-release fasteners being oriented in opposite directions facing away from the other quick-release fastener.

Furthermore, the telescopic extension according to the invention has a spring element that is fixedly connected with the rear quick-release fastener, i.e. also with the stationary inner rail, which is supported with a support surface in the insertion direction on the side rack in the assembled state of the telescopic extension, preferably on the rear vertical grid bar and/or the rear angled end section of the retaining bracket.

To mount the telescopic extension on the side rack, it is brought to the rear vertical grid bar or the rear angled end section of the retaining bracket with the rear quick-release fastener, and the rear-facing U-shaped section of the rear quick-release fastener is pushed or hooked over the vertical grid bar or the angled end section. The spring element is arranged in such a manner that it comes into contact with the side rack in the insertion direction and initially blocks the sliding of the U-shaped section of the rear quick-release fastener onto the vertical grid bar or the angled end section when the U-segments already grip around the vertical grid bar or the angled end section, but before the U-basis connecting the U-segments comes into contact with the vertical grid bar or the angled end section. The U-shaped section of the front quick-release fastener is designed and arranged in such a manner that its U-segment facing away from the inner rail cannot initially be guided around the front vertical grid bar or the front angled end section on the side facing the rear vertical grid bar.

By applying a force in the insertion direction, the U-shaped section of the rear quick-release fastener and thus also its U-basis can be pushed further towards the rear vertical grid bar or the rear angled end section against the spring force of the spring element, building up a spring preload in this process. The U-segment of the front quick-release fastener facing away from the inner rail is arranged and formed so that it can then be guided around and hooked into the front vertical grid bar or the front angled end section. When the force is released in the insertion direction, the spring pre-load of the spring element then ensures that the U-segments of the front quick-release fastener engage around the front vertical grid bar or the front angled end section, wherein the spring element is preferably configured so that it brings the U-basis of the front U-shaped section into contact with the front vertical grid bar or the front angled end section and presses it against them, so that the assembled telescopic extension is fixed to the side rack under the pretension of the spring element and without play.

For disassembly of the telescopic extension, a force is again applied in the insertion direction to the stationary inner rail, and the U-shaped sections of the quick-release fasteners are moved in the insertion direction against the spring force of the spring element until the U-shaped section of the front quick-release fastener can be disengaged from the front vertical grid bar again by a sideways movement, or from the front angled end section by an upward movement.

In a preferred embodiment of the invention, a sliding switch extending in the extension direction is arranged at the end of the stationary inner rail of the telescopic extension, for example a plate fixed to the rail back of the inner rail, which is bent through 90° at the end located in the extension direction and thus provides a surface which is easily accessible to a user for applying a force in the insertion direction.

In addition to the described U-shaped sections on the quick-release fasteners, the front quick-release fastener and the rear quick-release fastener of the telescopic extension according to the invention expediently each have support sections which, in the assembled state of the telescopic extension on the side rack, rest on the angled end sections of the retaining bracket and support the quick-release fasteners in a downward direction. Otherwise, the quick-release fasteners on the vertical grid bars would slide down. Alternatively or additionally, the support sections can also be supported on the horizontal section of the retaining bracket. The U-segments of the U-shaped sections of the quick-release fasteners can also serve as support sections for resting on the retaining bracket, and can be designed and arranged accordingly. When one or both of the U-shaped sections on the quick-release fasteners are provided for engagement with the angled end sections of the retaining bracket, the uppermost of the two U-segments supports the respective quick-release fastener in a downward direction.

In a further embodiment of the invention, the front quick-release fastener and/or the rear quick-release fastener of the telescopic extension comprise an abutment section which, in the assembled state of the telescopic extension, abuts against the side rack on the side of the respective vertical grid bar facing the stationary inner rail. Such an abutment section further stabilises the telescopic extension against tilting in the assembled state. The U-segments of the U-shaped sections of the quick-release fasteners can also serve as abutment sections and be designed and arranged accordingly.

An essential element of the telescopic extension according to the invention is a safety lug which, according to the invention and advantageously, is formed in one piece with the movable mounted outer rail. The safety lug is arranged in such a manner that it comes to rest in the insertion direction against the side rack, preferably against the front vertical grid bar or against the end section angled at the front relative to the horizontal section of the retaining bracket, when the moveably mounted outer rail is moved into its insertion end position or when a force acts on the moveably mounted outer rail in its insertion end position in the insertion direction and against the spring force of the spring element.

As described above, the telescopic extension according to the invention is disassembled from the side rack by applying a force to the stationary inner rail in the insertion direction, wherein the U-shaped sections of the quick-release fasteners are pushed in the insertion direction against the spring force of the spring element, and the U-shaped section of the front quick-release fastener is disengageable from the front vertical grid bar or the front angled end portion. The safety lug according to the invention blocks and prevents unintentional displacement of the quick-release fasteners and disengagement of the telescopic extension with the side rack, if, for example, a holder is pushed in to the insertion end position of the outer rail and further force is thereby applied in the insertion direction, which is then transferred to the inner rail.

In a preferred embodiment of the invention, the safety lug made of the sheet steel of the moveably mounted outer rail is formed as a lug bent up perpendicularly to the extension direction of the moveably mounted outer rail at its end located in the extension direction.

The invention also comprises a quick-release fastener system for mounting cooking tray supports in an oven, preferably a pyrolytic oven, having a pair of mirror-symmetrically formed side racks which are fixed or fixable to opposite inner side walls of the oven, and having at least one pair of telescopic extensions according to the invention as described herein.

FIGURES

Further advantages, features and possible applications of the present invention will become clear from the following description of an embodiment according to the invention and the accompanying figures. In the figures, like elements are identified using like reference signs.

Figure 1:
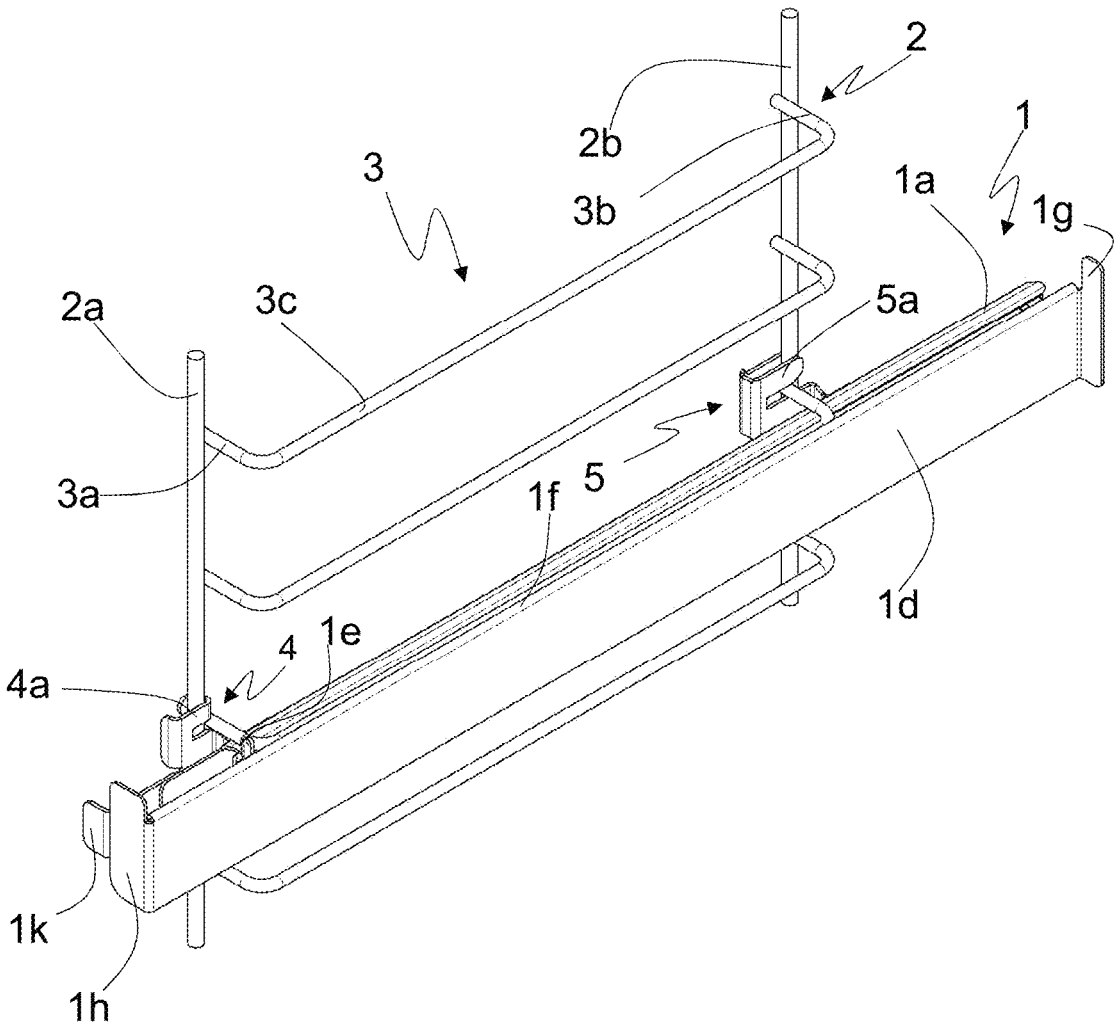
FIG. 1 shows a perspective schematic view of an embodiment of a side rack of a baking oven with an embodiment of a telescopic extension according to the invention mounted thereon, viewed obliquely from the front onto the support plate.
Figure 5:
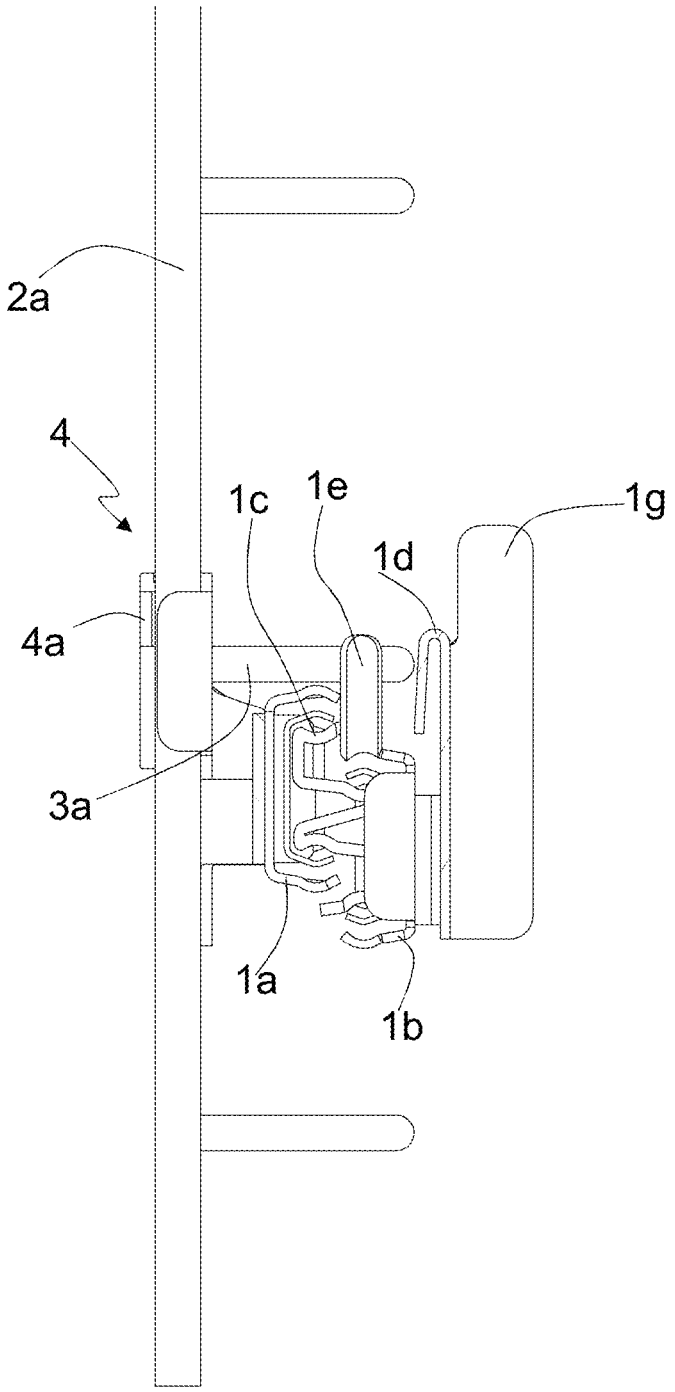

FIG. 5 shows a cross-sectional view of the embodiment according to FIG. 1, looking in the insertion direction at the front of the telescopic extension according to the invention mounted on the side rack, wherein the section in the front area of the telescopic extension is behind the end cap of the support plate but in front of the safety lug on the outer rail, and the balls of the ball bearings between the rail elements are hidden.

Figure 6:
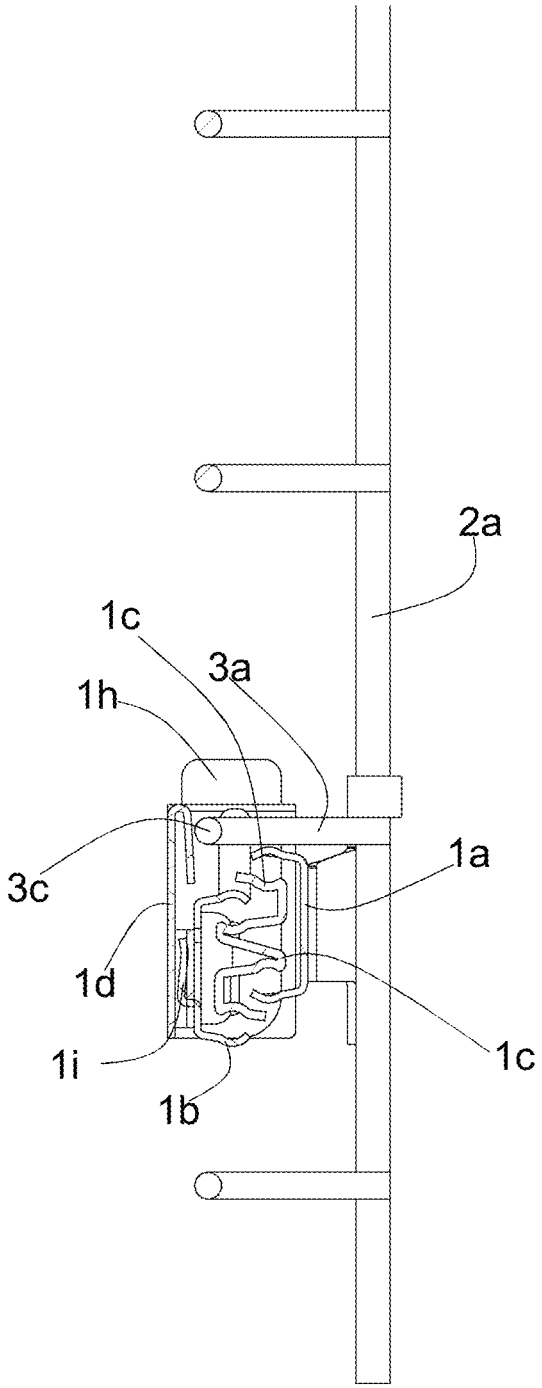

FIG. 6 shows a cross-sectional view of the embodiment according to FIG. 1, viewed in the extension direction.

Figure 7A:
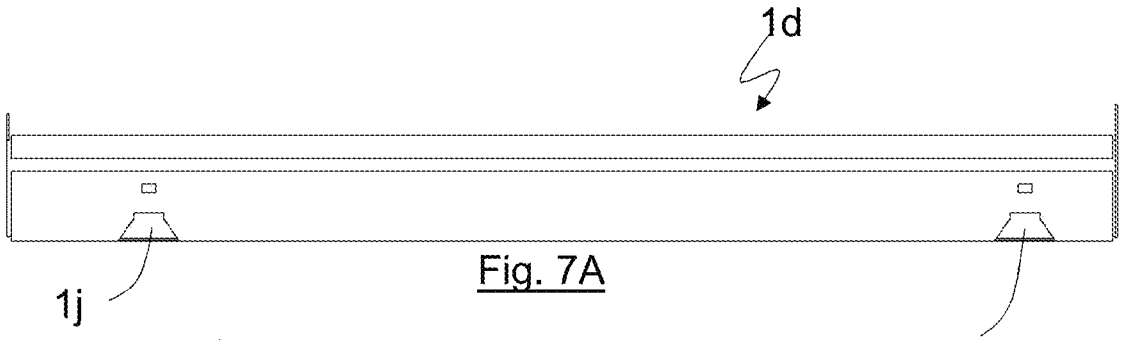
Figure 7B:
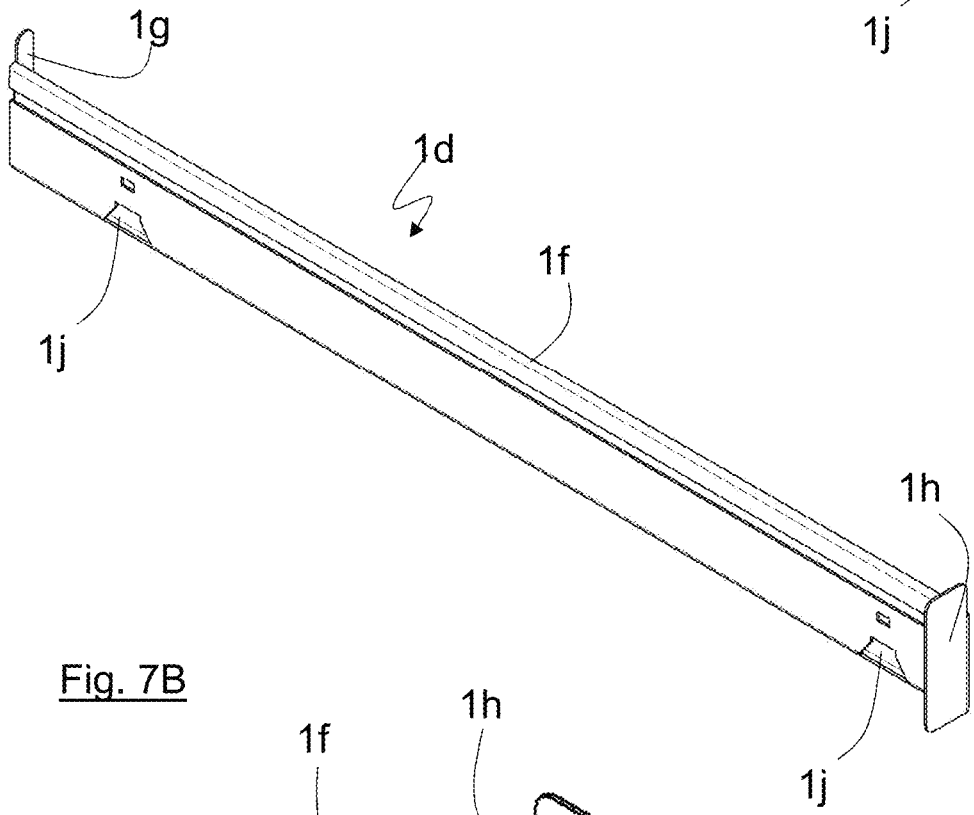
Figure 7C:
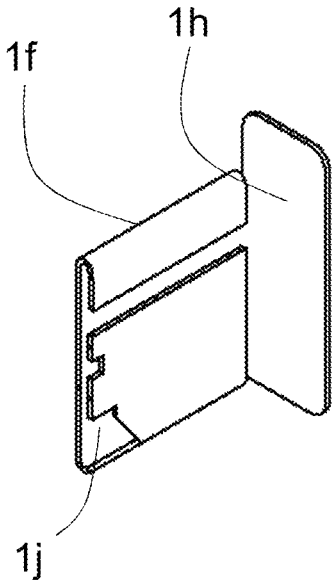

FIGS. 7A-C show schematic views of an alternative embodiment of a support plate according to the invention, in which the recesses for hook-shaped lugs on the outer rail are formed in one piece with the support plate and are shaped in a section folded over along the lower edge of the support plate in the direction of the outer rail.

Figure 3:
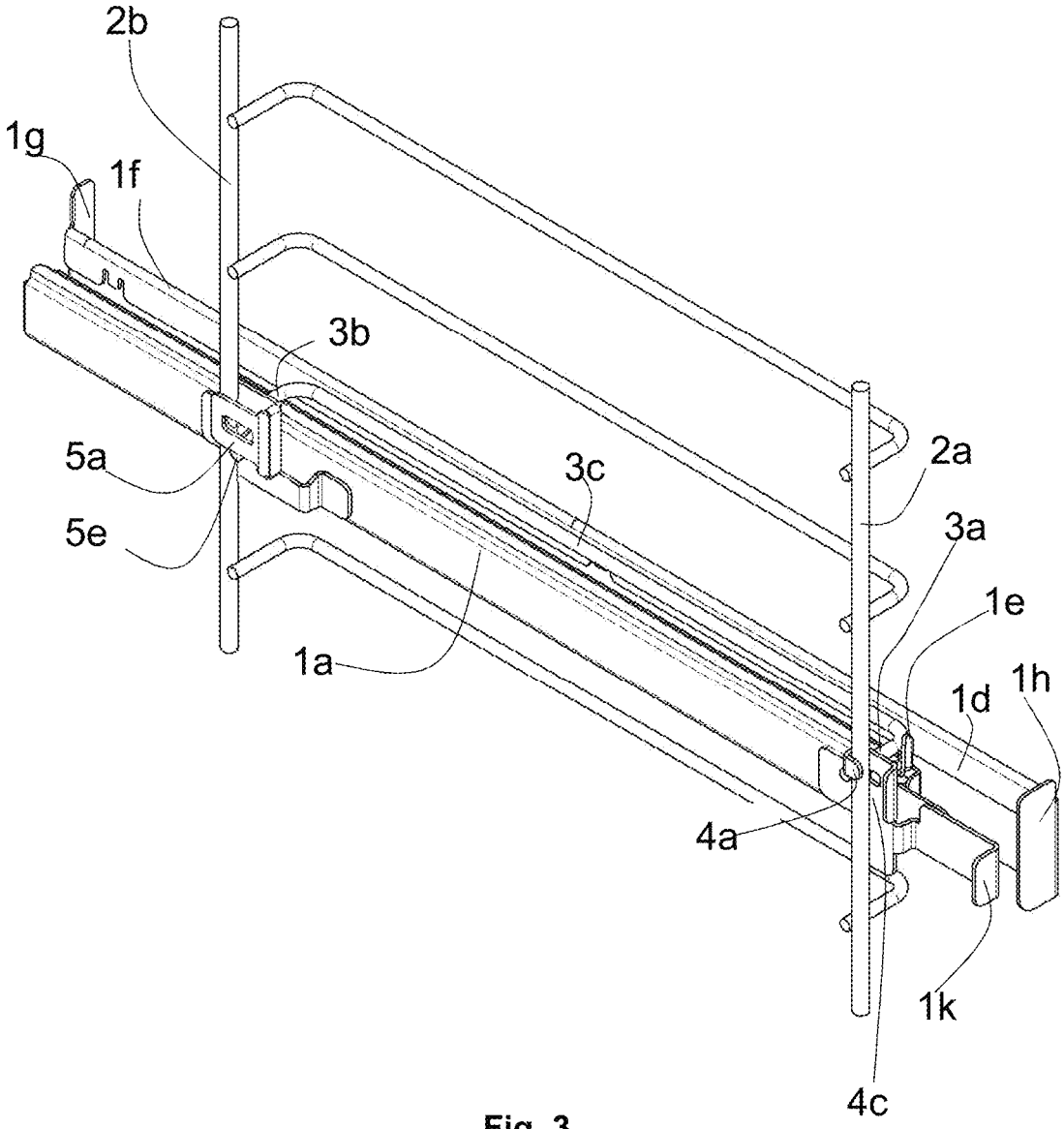
FIG. 3 shows the embodiment according to FIG. 1 with an oblique view of the inner rail from behind.
Figure 8A:
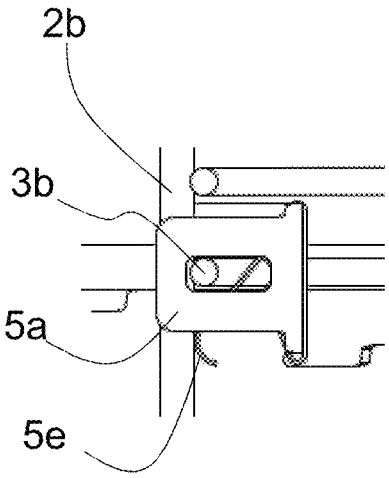
Figure 8B:
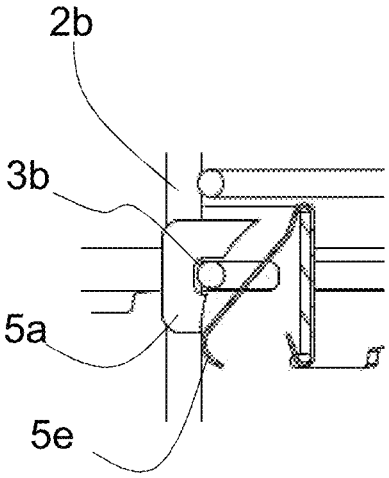
Figure 8C:
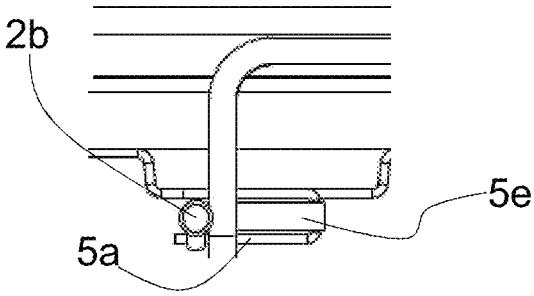

FIGS. 8A-C show enlarged schematic views of the U-shaped section 5*a* of the rear quick-release fastener shown in FIG. 3.

Figure 9:
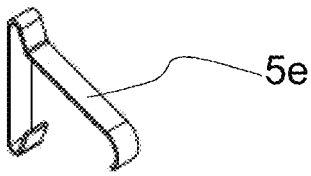

FIG. 9 shows a perspective view of the spring element of FIGS. 3 and 8A-C.

The figures show an embodiment according to the invention of a telescopic extension 1 designed as a full extension with a stationary inner rail 1*a*, a middle rail 1*c* mounted to move relative to the stationary inner rail via a ball bearing, and an outer rail 1*b* mounted to move relative to the middle rail via a further ball bearing. As shown in FIGS. 5 and 6, the stationary inner rail 1*a* and the movable outer rail 1*b* have a profile that is essentially C-shaped in cross-section with ball raceways on the opposite C-legs of the respective rail profile and a rail back connecting the two C-legs. The balls of the ball bearings are not shown in the figures.

The telescopic extension 1 is mounted on a side rack 2, preferably a side rack fixed or fixable to the muffle side wall of a baking oven, which has a front vertical grid bar 2*a* and a rear vertical grid bar 2*b* spaced apart from it, and arranged substantially parallel thereto, and a plurality of retaining brackets 3 arranged one above the other. Each of the retaining brackets consists of a horizontal section 3*c* and front and rear end sections 3*a* and 3*b*, which are angled substantially vertically at opposite ends of the horizontal section 3*c*, and welded with their free ends to the vertical grid bars 2*a* and 2*b* respectively.

Figure 2:
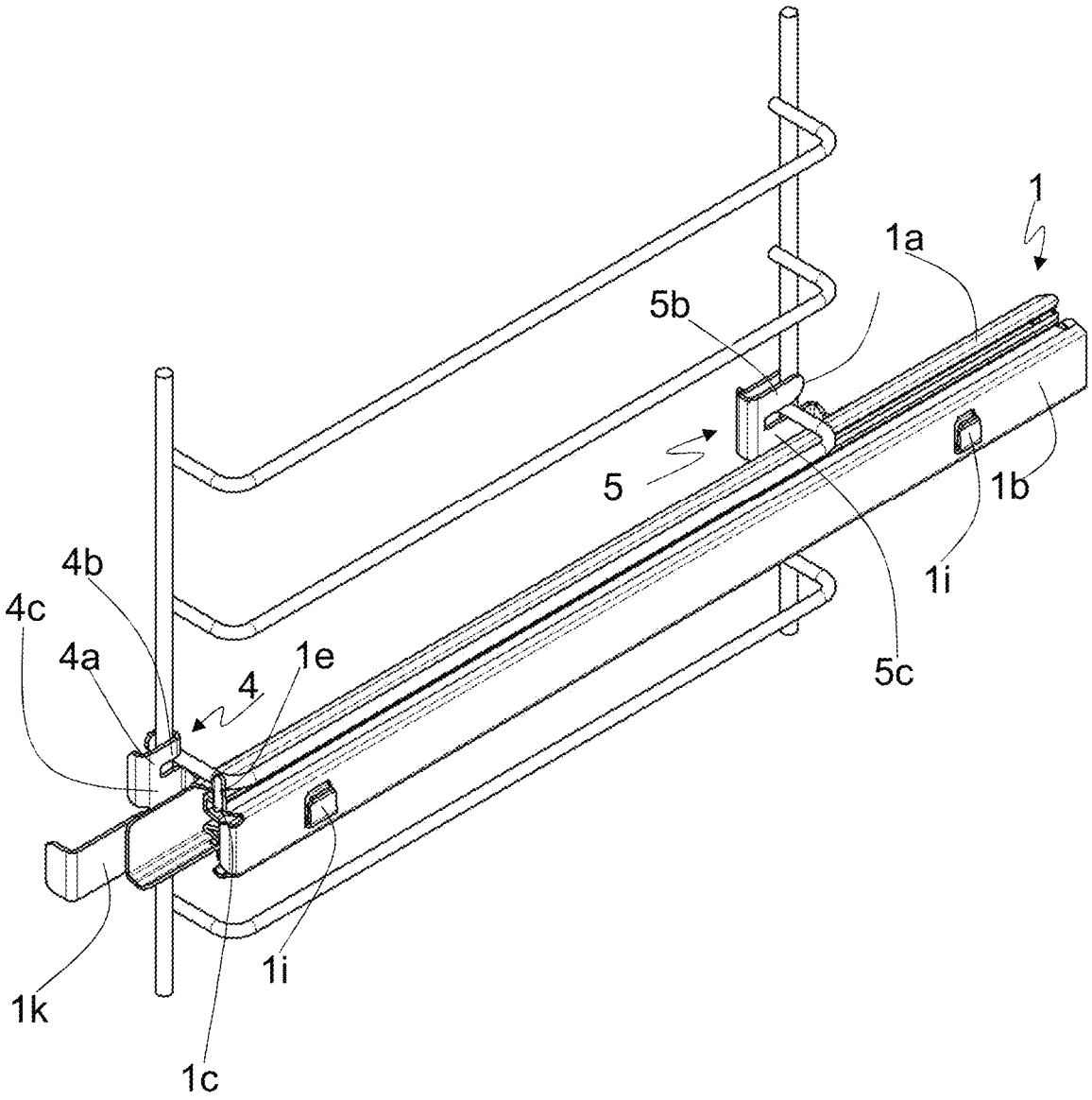
FIG. 2 shows the embodiment according to FIG. 1 without the support plate according to the invention in the same viewing direction as in FIG. 1.
Figure 4:
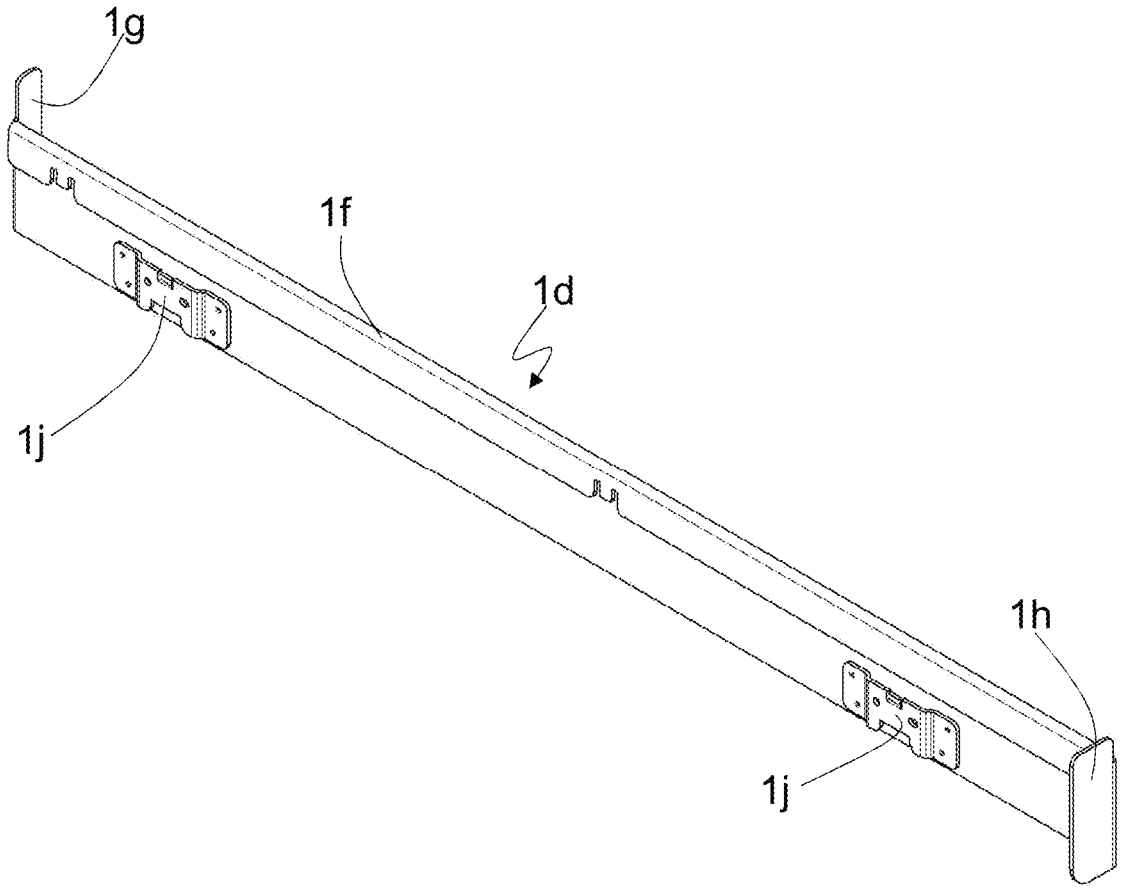
FIG. 4 shows a schematic perspective view of the support plate according to the invention, viewed obliquely from behind, as in FIG. 3.

In this embodiment, the telescopic extension 1 furthermore comprises a support plate 1d attached to the outer rail. FIGS. 1, 3, 5 and 6 show the telescopic extension 1 with the support plate 1d attached to the outer rail, while FIG. 2 shows the telescopic extension 1 without the support plate, and FIG. 4 shows a view of the support plate 1d alone. FIGS. 7A-C show an alternative embodiment of a suitable support plate 1d according to the invention.

The telescopic extension 1 is detachably mounted to the vertical grid bars 2*a* and 2*b*, as well as a retaining bracket 3 of the side rack 2 by means of two front and rear quick-release fasteners 4 and 5 fixed to the stationary inner rail la at a distance from each other in such a manner that all rail elements of the telescopic extension 1 are arranged below the retaining bracket 3. The quick-release fasteners 4 and 5 each have a U-shaped section 4*a* and 5*a*, respectively, with their openings oriented in opposite directions facing away from the other quick-release fastener. The U-shaped section 4*a* of the front quick-release fastener 4 grips the front vertical grid bar 2*a*, and the U-shaped section 5*a* of the rear quick-release fastener 5 grips the rear vertical grid bar 2*b*.

In the present embodiment, a leaf spring element 5*e* is arranged on the rear quick-release fastener 5 between the U-segments of the U-shaped section 5*a*; this leaf spring element is supported in the assembled state of the telescopic extension 1 with a support surface biased in the insertion direction on the rear vertical grid bar 2*b*, holds the U-shaped section 4*a* of the front quick release fastener 4 in engagement with the front vertical grid bar 2*a*, and presses the U-basis of the U-shaped section 4*a* of the front quick-release fastener 4, which connects the U-segments, against the front vertical grid bar 2*a* in the extension direction.

At the end of the stationary inner rail 1*a* of the telescopic extension, which is located in the extension direction, a sliding switch 1*k* which extends in the extension direction is arranged; in this embodiment, it is designed as a plate welded to the rail back of the inner rail 1*a* and bent through 90° at the free end. The bent-over portion of the sheet provides an easily accessible surface for the user to apply a force in the insertion direction, for example by pressing with the thumb in the insertion direction, to displace the stationary inner rail 1*a* in the insertion direction and against the spring force of the spring element over a distance for disassembly of the telescopic extension, sufficient to disengage the U-shaped section 4*a* of the front quick-release fastener 4 from the front vertical grid bar 2*a* and to remove the telescopic extension 1 from the vertical grid bar 2*a* with a sideways movement.

In the present embodiment, the respective U-segments of the U-shaped sections 4*a* and 5*a* facing the inner rail 1*a* on the quick-release fasteners 4 and 5 serve as support sections 4*b* and 5*b*, respectively, which rest on the angled end sections 3*a* and 3*b* of the retaining bracket 3 when the telescopic extension 1 is mounted on the side rack, support the quick-release fasteners 4 and 5 thereon, and prevent the quick-release fasteners from sliding downwards on the vertical grid bars. Furthermore, the quick-release fasteners 4 and 5 have abutment sections 4*c* and 5*c* which, when the telescopic extension 1 is assembled, abut the sides of the vertical grid bars 2*a* and 2*b* facing the stationary inner rail 1*a* and stabilise the telescopic extension against tilting when assembled. Sections of the U-segments of the U-shaped sections 4*a* and 5*a* of the quick-release fasteners 4 and 5 also serve as abutment sections in the present embodiment.

A further essential element of the telescopic extension according to the invention consists of the safety lug 1*e*, which is formed in one piece with the movable outer rail 1*b* according to the invention. In the present embodiment, the safety lug 1*e* is formed as a lug bent up vertically at the end lying in the extension direction and from the C leg of the outer rail formed as a ball raceway, which is arranged in such a manner that it comes into contact with the front angled end portion 3*a* of the retaining bracket 3 in the insertion direction, when the moveably mounted outer rail 1*b* is moved into its insertion end position or when a force acts on the moveably mounted outer rail in its insertion end position in the insertion direction, and against the spring force of the spring element.

While the sliding switch 1*k* according to the invention serves to exert a force in the insertion direction on the stationary inner rail 1*a* for an intended disassembly of the telescopic extension 1 and to move it in the insertion direction against the spring force of the spring element in order to bring the U-shaped section 4*a* of the front quick-release fastener 4 out of engagement with the front vertical grid bar 2*a*, the safety lug 1*e* according to the invention blocks and prevents an unintentional displacement of the quick-release fasteners 4 and 5 and a disengagement of the telescopic extension 1 with the side rack 2, if, for example, a holder is pushed in up to the insertion end position of the outer rail 1*b* and further force is applied in the insertion direction, which is then transmitted to the inner rail.

In the present embodiment, the telescopic extension 1 according to the invention has a support plate 1*d* which is detachably attached to the rail back of the outer rail 1*b*, with a support surface 1*f* on its upper side for supporting a holder. As can be seen in the cross-sectional views of FIGS. 5 and 6, the support plate 1*d* is designed and fixed to the outer rail in such a manner that the support surface 1*f* is arranged above the upper sides of the rail elements of the telescopic extension 1 and above the retaining bracket 3.

In the present embodiment, the surface of the support plate 1*d* is provided with a transparent, temperature-resistant coating that protects the surface from discolouration, as often occurs on unprotected steel or stainless steel surfaces due to the high temperatures applied during pyrolysis in baking ovens.

The support plate is attached to the rail back of the movable outer rail 1*b* by means of a bayonet or hook connection. For this purpose, two upward-directed hook-shaped lugs 1*i* are arranged in the rail back of the outer rail 1*b*, which are formed in one piece with the outer rail 1*b* by punching out the contours of the lugs in the steel sheet of the rail back during the manufacture of the outer rail and then bending the sheet to form the hook-shaped lugs.

On the side of the support plate 1*d* facing the rail back of the outer rail 1*b*, corresponding recesses 1*j* are arranged for engagement with the hook-shaped lugs 1*i*, which are hooked into the hook-shaped lugs 1*i* from above. In the embodiment shown in FIGS. 1 to 6, the recesses 1*j*, as shown in FIG. 4, are formed by welded-on metal sheets with a hat profile.

In an alternative embodiment of the support plate 1*d* shown in FIGS. 7A-C, the recesses 1*j* are formed in one piece with the support plate 1*d* and are formed in a section of the support plate 1*d* that is folded over along the lower edge of the support plate 1*d* in the direction of the outer rail.

Both embodiments of the support plates 1*d* shown in the figures have an end stop 1*g* at the end located in the insertion direction, which forms a stop against displacement of a holder placed on the support plate 1*d* in the insertion direction beyond the end of the support plate 1*d* located in the insertion direction. The end stop 1*g* is formed in one piece with the support plate 1*d* and formed as a lug bent out of the steel sheet of the support plate perpendicular to the insertion direction.

Furthermore, both embodiments of the support plate 1*d* shown in the figures have an end cap 1*h* at the end located in the extension direction, which is formed in one piece with the support plate 1*d* as a lug bent out of the steel sheet of the support plate in the direction of the movable outer rail and, in the assembled state, at least partially covers the end of the movable outer rail 1*b* located in the extension direction. The end cap 1*h* forms a stop in the extension direction for a mounted holder in order to prevent the holder from being pulled down from the telescopic extension 1 when the outer rail 1*b* has reached its extension end position during extension from the oven.

For the purposes of original disclosure, it should be noted that all of the features as they become apparent to a skilled person based on the present description, the drawings, and the claims, even if they have been specifically described only in connection with specific other features, can be combined both individually and in any combination with other features or groups of features disclosed here, insofar as this has not been expressly excluded or technical circumstances make such combinations impossible or pointless. A comprehensive, explicit presentation of all conceivable combinations of features is omitted here solely for the sake of the brevity and legibility of the description.

Although the invention has been presented and described in detail in the drawings and the foregoing description, this representation and description is made merely by way of example and is not intended to limit the scope of protection as defined by the claims. The invention is not limited to the embodiments shown.

Modifications of the disclosed embodiments will be obvious to the skilled person based on the drawings, the description, and the appended claims. In the claims, the word "comprise" does not exclude other elements or steps, and the indefinite article "a" or "one" does not exclude a plurality. The mere fact that certain features are claimed in different claims does not preclude their combination. The reference signs in the claims are not intended to limit the scope of protection.

LIST OF REFERENCE NUMBERS

1 Telescopic extension
1*a* Inner rail
1*b* Outer rail
1*c* Middle rail
1*d* Support plate
1*e* Safety lug
1*f* Support surface of the support plate
1*g* End stop
1*h* End cap
1*i* Hook-shaped lugs
1*j* Recesses
1*k* Sliding switch
2 Side rack
2*a* Front vertical grid bar
2*b* Rear vertical grid bar
3 Retaining bracket
3*a* Front angled end portion of the retaining bracket
3*b* Rear angled end portion of the retaining bracket
3*c* Horizontal portion of the retaining bracket
4 Front quick-release fastener
4*a* U-shaped section
4*b* Support section
4*c* Abutment section
5 Rear quick-release fastener
5*a* U-shaped section
5*b* Support section
5*e* Spring element
5*c* Abutment section

The invention claimed is:

1. A telescopic extension comprises:

a stationary inner rail;

an outer rail mounted so as to be movable relative to the stationary inner rail between an insertion end position and an extension end position in an insertion direction and an extension direction opposite thereto;

a front quick-release fastener and a rear quick-release fastener fixed to the stationary inner rail at a distance from each other;

a spring element arranged in fixed connection with the rear quick-release fastener and/or the stationary inner rail;

wherein said telescopic extension is provided and adapted to be detachably mounted on a side rack having a front vertical grid bar and a rear vertical grid bar spaced therefrom and substantially parallel thereto and at least one retaining bracket which has a horizontal section and, at opposite ends of the horizontal section, front and rear end sections which are each angled substantially perpendicularly with respect to the horizontal section, the front end section being connected to the front vertical grid bar and the rear end section being connected to the rear vertical grid bar, wherein the front quick-release fastener has a U-shaped section for engagement with the front vertical grid bar and/or with the front angled end section of the retaining bracket, and the rear quick-release fastener has a U-shaped section for engagement with the rear vertical grid bar and/or with the rear angled end section of the retaining bracket, wherein the openings of the U-shaped sections of the quick-release fasteners are oriented in opposite directions facing away from the other quick-release fastener, wherein the spring element, in the mounted state of the telescopic extension, is supported with a support surface in the insertion direction on the side rack, and, in the relaxed or pretensioned state, holds the U-shaped section of the front quick-release fastener in engagement with the front vertical grid bar and/or with the front angled end section of the retaining bracket, wherein the stationary inner rail is movable over a distance by applying a force to the stationary inner rail in the insertion direction and against the spring force of the spring element, such that the U-shaped section of the front quick-release fastener is disengageable from the front vertical grid bar, wherein a safety lug is arranged on an element of the telescopic extension which is mounted so as to be displaceable relative to the stationary inner rail in such a way that it comes to rest in the insertion direction against the side rack, when the moveably mounted outer rail is displaced into its insertion end position or when a force acts on the moveably mounted outer rail in its insertion end position in the insertion direction and against the spring force of the spring element, and blocks a movement of the stationary inner rail over a distance that the U-shaped section of the front quick-release fastener can be brought out of engagement with the front vertical grid bar and/or with the front angled end section of the retaining bracket, wherein the stationary inner rail and the outer rail are made of sheet steel, and wherein the safety lug is formed in one piece with the movable mounted outer rail.

2. The telescopic extension according to claim 1, wherein the safety lug made of the steel plate of the moveably mounted outer rail is formed at its end located in the extension direction as a lug bent up perpendicularly to the extension direction of the moveably mounted outer rail.

3. The telescopic extension according to claim 1, further comprising a support plate fastened to the outer rail.

4. The telescopic extension according to claim 3, wherein the support plate has a support surface on the upper side for supporting a holder.

5. The telescopic extension according to claim 3, wherein the support plate has an end stop at the end located in the insertion direction, which is formed in one piece with the support plate as a lug bent out of the steel plate of the support plate perpendicularly to the insertion direction and forms a stop against displacement of a holder placed on the support plate in the insertion direction beyond the end of the support plate located in the insertion direction.

6. The telescopic extension according to claim 3, wherein the support plate has an end cap at the end located in the extension direction, which end cap is formed in one piece with the support plate as a lug bent out of the steel sheet of the support plate in the direction of the movable outer rail and at least partially covers the end of the movable outer rail located in the extension direction.

7. The telescopic extension according to claim 3, wherein the surface of the support plate has at least partially a coating produced by PVD, CVD, plasma CVD, plasma spraying or high-speed flame spraying or deposited by electroplating.

8. The telescopic extension according to claim 3, wherein on a side of the outer rail facing away from the inner rail at least two hook-shaped lugs, and on a side of the support plate facing the outer rail are arranged recesses formed for engagement with the hook-shaped lugs on the outer rail for releasably fastening the support plate to the outer rail or wherein at least two hook-shaped lugs are provided on the side of the support plate facing the outer rail, and recesses formed on the support plate for engagement with the hook-shaped lugs are arranged on the side of the outer rail facing away from the inner rail for releasably fastening the support plate to the outer rail.

9. The telescopic according to claim 8, wherein the recesses formed on the outer rail or on the support plate are fixed by welding, spot welding, riveting or screwing.

10. The telescopic extension according to claim 8, wherein the hook-shaped lugs are formed in one piece with the outer rail or the support plate by cutting or punching out and bending from the steel sheet.

11. The telescopic extension according to claim 3, wherein the support plate is made of sheet steel.

12. The telescopic extension according to claim 1, wherein the spring element is a leaf spring element which is arranged between U-segments of the U-shaped section of the rear quick-release fastener and can be biased with the spring force in the insertion direction, wherein the support surface of the spring element, which is provided for supporting the spring element in the insertion direction on the side rack, is arranged at a distance from U-basis of the U-shaped section of the rear quick-release fastener connecting the U-segments.

13. The telescopic extension according to claim 1, wherein, in the mounted state of the telescopic extension on the side rack, the U-shaped section of the rear quick-release fastener engaging around the rear vertical grid bar or the rear angled end section of the retaining bracket is at such a distance from the U-shaped section of the front quick-release fastener that grasps around the front vertical grid bar or the front angled end section of the retaining bracket that U-segments of the U-shaped section of the rear quick-release fastener embrace the rear vertical grid bar or the rear angled end section of the retaining bracket, without U-basis of the U-shaped section of the rear quick-release fastener that connects the U-segments coming into contact with the rear vertical grid bar or the rear angled end section of the retaining bracket, when the U-shaped section of the front quick-release fastener embraces the front vertical grid bar or the front angled end section of the retaining bracket in such a manner that the U-basis of the U-shaped section of the front quick-release fastener connecting the U-segments is in abutment with the front vertical grid bar or with the front angled end section of the retaining bracket.

14. The telescopic extension according to claim 1, wherein a sliding switch extending in the extension direction is arranged at the end of the stationary inner rail located in the extension direction.

15. The telescopic extension according to claim 1, wherein the front quick-release fastener and the rear quick-release fastener each have support portions which, in the assembled state of the telescopic extension, rest on the side rack on the angled end sections of the retaining bracket.

16. The telescopic extension according to claim 1, wherein the front quick-release fastener and/or the rear quick-release fastener has an abutment portion which, in the assembled state of the telescopic extension, abuts the side rack on the side of the vertical grid bar facing the stationary inner rail.

17. The telescopic extension according to claim 1, wherein the telescopic extension is provided and designed as a cooking tray for detachable mounting on a side rack of a baking oven.

18. A quick-release fastener system for mounting cooking trays in an oven, comprising a pair of mirror-symmetrically shaped side racks which are fixed or fixable to opposite inner side walls of the oven, and at least one pair of the telescopic extensions according to claim 1.

19. The telescopic extension according to claim 1, further comprising a middle rail arranged between the inner rail and the outer rail and mounted so as to be movable relative thereto.

20. The telescopic extension according to claim 1, wherein the support surface is on the rear vertical grid bar and/or the rear angled end section of the retaining bracket.

21. The telescopic extension according to claim 1, wherein the safety lug is arranged on an element of the telescopic extension in such a way that it comes to rest in the insertion direction against the front vertical grid bar or against the front angled end section of the retaining bracket.

* * * * *